US008566101B2

(12) United States Patent
Han et al.

(10) Patent No.: US 8,566,101 B2
(45) Date of Patent: Oct. 22, 2013

(54) APPARATUS AND METHOD FOR GENERATING AVATAR BASED VIDEO MESSAGE

(75) Inventors: Ick-sang Han, Yongin-si (KR); Jeong-mi Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 239 days.

(21) Appl. No.: 12/754,303

(22) Filed: Apr. 5, 2010

(65) Prior Publication Data

US 2010/0286987 A1 Nov. 11, 2010

(30) Foreign Application Priority Data

May 7, 2009 (KR) ..... 10-2009-0039786

(51) Int. Cl.
*G10L 11/00* (2006.01)

(52) U.S. Cl.
USPC ..... 704/270; 704/271; 704/272; 704/278

(58) Field of Classification Search
None
See application file for complete search history.

(56) References Cited

U.S. PATENT DOCUMENTS

| | | | | |
|---|---|---|---|---|
| 5,799,276 | A * | 8/1998 | Komissarchik et al. | 704/251 |
| 6,604,078 | B1 | 8/2003 | Shimazaki | |
| 7,139,767 | B1 * | 11/2006 | Taylor et al. | 1/1 |
| 7,203,648 | B1 * | 4/2007 | Ostermann et al. | 704/260 |
| 2002/0133350 | A1 * | 9/2002 | Cogliano | 704/270 |
| 2007/0011011 | A1 * | 1/2007 | Cogliano | 704/272 |
| 2008/0151786 | A1 * | 6/2008 | Li et al. | 370/276 |
| 2008/0269958 | A1 * | 10/2008 | Filev et al. | 701/1 |
| 2009/0002479 | A1 * | 1/2009 | Sangberg et al. | 348/14.02 |
| 2009/0276802 | A1 * | 11/2009 | Amento et al. | 725/32 |
| 2010/0057455 | A1 * | 3/2010 | Kim et al. | 704/235 |
| 2010/0137030 | A1 * | 6/2010 | Ma | 455/563 |
| 2010/0153858 | A1 * | 6/2010 | Gausman et al. | 715/757 |

FOREIGN PATENT DOCUMENTS

| | | |
|---|---|---|
| KR | 10-2001-0058733 | 7/2001 |
| KR | 10-2002-003833 | 1/2002 |
| KR | 10-2002-0066805 | 8/2002 |
| KR | 10-2003-0086756 | 11/2003 |
| KR | 10-2004-0025029 | 3/2004 |
| KR | 10-2004-0051921 | 6/2004 |
| KR | 10-2004-0076524 | 9/2004 |
| KR | 10-2004-0093510 | 11/2004 |
| KR | 10-2004-0103047 | 12/2004 |
| KR | 10-2006-0080349 | 7/2006 |
| WO | WO 2005/031995 | 4/2005 |

* cited by examiner

*Primary Examiner* — Leonard Saint Cyr
(74) *Attorney, Agent, or Firm* — NSIP Law

(57) ABSTRACT

An apparatus and method for generating an avatar based video message are provided. The apparatus and method are capable of generating an avatar based video message based on speech of a user. The avatar based video message apparatus and method displays information that corresponds to input user speech. The avatar based video message apparatus and method edits the input user speech according to a user input signal with reference to the displayed information, generates avatar animation according to the edited speech, and generates an avatar based video message based on the edited speech and the avatar animation.

19 Claims, 10 Drawing Sheets

FIG.5

| WORD SEQUENCE | START TIME |
|---|---|
| NAENGJANGGO (REFRIGERATOR) | 0.630 |
| AHNE (IN) | 0.851 |
| DONEOT (DONUD) | 1.206 |
| DONEOCH (DONUT) | 1.717 |
| ITSEUNI (KEPT) | 2.205 |
| UYULANG (WITH MILK) | 2.822 |
| MEOGEO (EAT) | 3.172 |

510

| WORD SEQUENCE | START TIME |
|---|---|
| NAENGJANGGO AHNE (IN REFRIGERATOR) | 0.851 |
| DONEOT (DONUD) | 1.206 |
| DONEOCH (DONUT) | 1.717 |
| ITSEUNI (KEPT) | 2.205 |
| UYULANG (WITH MILK) | 2.822 |
| MEOGEO (EAT) | 3.172 |

520

APPARATUS AND METHOD FOR GENERATING AVATAR BASED VIDEO MESSAGE

CROSS-REFERENCE TO RELATED APPLICATION

This application claims the benefit under 35 U.S.C. §119 (a) of Korean Patent Application No. 10-2009-0039786, filed on May 7, 2009, the entire disclosure of which is incorporated herein by reference for all purposes.

BACKGROUND

1. Field

The following description relates to a message providing system, and more particularly, to an apparatus and method for generating a speech based message.

2. Description of the Related Art

Recently, a cyber space service has been developed in which users fabricate their own avatars in cyber space and chat in a community over a network. The avatars allow users to express their own characteristics in cyber space while remaining in a position of somewhat anonymity. For example, the user may deliver not only a simple text message but also a voice message together with an avatar including recorded speech sound. However, it is more difficult for a user to edit his/her speech than it is to edit text.

SUMMARY

In one general aspect, provided is an apparatus for generating an avatar based video message, the apparatus including an audio input unit to receive speech of a user, a user input unit to receive input from a user, a display unit to output display information, and a control unit to perform speech recognition based on the speech of the user to generate editing information, to edit the speech based on the editing information, to generate avatar animation based on the edited speech, and to generate an avatar based video message based on the edited speech and the avatar animation.

The editing information may include a word sequence converted from the speech and s synchronization information for speech sections corresponding to respective words included in the word sequence.

The control unit may determine an editable location in the word sequence and output information indicating the editable location through the display unit.

The information indicating the editable location may include visual indication information that is used to display the word sequence such that the word sequence is differentiated into units of editable words.

The control unit may control the display unit such that a cursor serving as the visual indication information moves in steps of editable units in the word sequence.

The control unit may edit the word sequence at the editable location according to a user input signal.

The control unit may determine, as the editable location, a location of a boundary that is positioned among speech sections corresponding to the respective words of the word sequence and has an energy below a predetermined threshold value.

The control unit may calculate a linked sound score that refers to an extent to which at least two words included in the word sequence are recognized as linked sounds, the control unit may calculate a clear sound score that refers to an extent to which the at least two words are recognized as a clear sound, and if a value obtained by subtracting the clear score from the linked score is below a predetermined threshold value, the control unit may determine that the at least two words are vocalized as a clear sound and may determine, as the editable location, a location corresponding to a boundary between the at least two words determined as the clear sound.

The control unit may edit the speech based on an editing action that includes at least one of a deletion, a replacement, and an insertion, wherein the deletion action deletes at least one word included in the word sequence, the replacement action replaces at least one word included in the word sequence with one or more other words, and the insertion action inserts one or more new words into the word sequence.

The control unit may include a silence duration corrector to shorten a section of silence included in new speech that is input to modify at least one word included in the word sequence or to insert a new word into the word sequence.

In another aspect, provided is a method of generating an avatar based video message, the method including performing speech recognition on input speech, generating editing information based on the performed speech recognition, editing the speech based on the editing information, generating avatar animation based on the edited speech, and generating an avatar based video message based on the edited speech and the avatar animation.

The editing information may include a word sequence converted from the speech and synchronization information for speech sections corresponding to respective words included in the word sequence.

The editing of the speech may include determining an editable location in the word sequence and displaying information indicating the editable location, and editing the word sequence at the editable location, wherein the editable location is selected according to a user input signal.

The information indicating the editable location may include visual indication information that is used to display the word sequence such that the word sequence is differentiated into units of editable words.

The editable location may represent a location of a boundary that is positioned among speech sections corresponding to the respective words of the word sequence and has an energy below a predetermined threshold value.

The method may further include subtracting a clear sound score that refers to an extent to which at least two words included in the word sequence are recognized as a clear sound, from a linked sound score that refers to an extent to which the at least two words are recognized as a linked sound, and if the subtraction value is below a predetermined threshold value, determining that the at least two words are vocalized as a clear sound and determining, as the editable location, a location corresponding to a boundary between the at least two words determined as the clear sound.

The speech may be edited based on at least one editing action that includes at least one of a deletion, a replacement, and an insertion, wherein the deletion action deletes at least one word included in the word sequence, the replacement action replaces at least one word included in the word sequence with one or more other words, and the insertion action inserts one or more new words into the word sequence.

The editing of the speech may include shortening a section of silence included in new speech that is input to modify at least one word included in the word sequence or to insert a new word into the word sequence.

Other features and aspects will be apparent from the following detailed description, the drawings, and the claims.

BRIEF DESCRIPTION OF THE DRAWINGS

FIG. 5 is an example of a table generated based on an editable unit.

Figure 1:
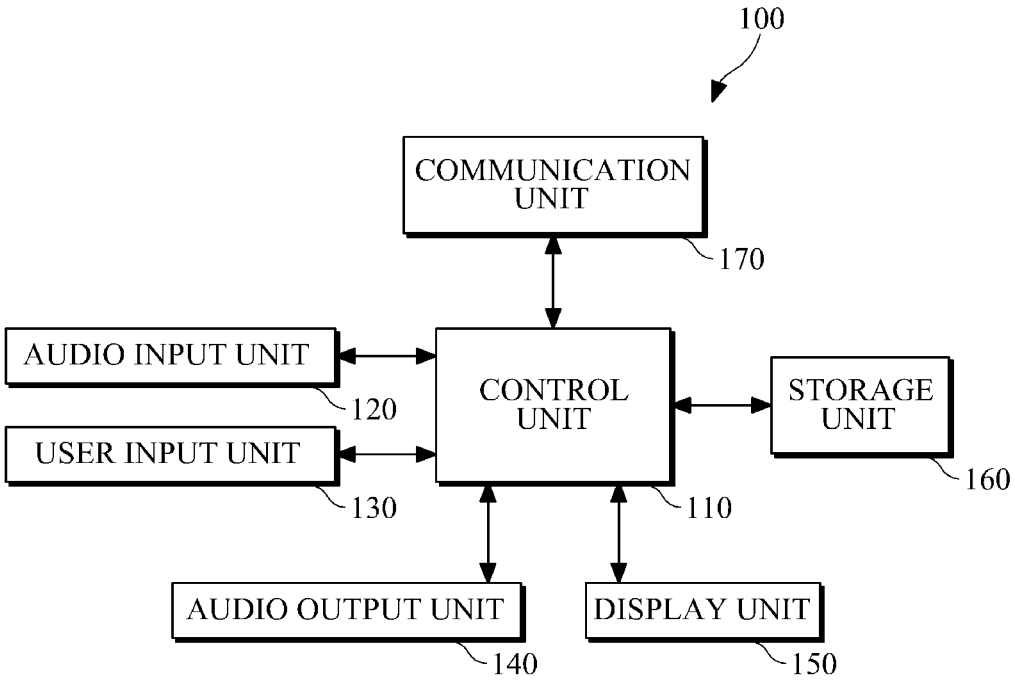
FIG. 1 is a diagram illustrating an example of an apparatus for generating an avatar based video message.

Throughout the drawings and the detailed description, unless otherwise described, the same drawing reference numerals are understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein may be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Descriptions of well-known functions and structures may be omitted for increased clarity and conciseness.

FIG. 1 illustrates an example of an apparatus for generating an avatar based video message.

Referring to FIG. 1, an example avatar based video message generating apparatus 100 (hereinafter "apparatus 100") includes a control unit 110, an audio input unit 120, a user input unit 130, an output unit 140, a display unit 150, a storage unit 160, and a communication unit 170.

The control unit 110 may include a data processor to control an overall operation of the apparatus 100 and a memory that stores data for data processing. The control unit 110 may control the operation of the audio input unit 120, the user input unit 130, the output unit 140, the display unit 150, the storage unit 160, and/or the communication unit 170. The audio input unit 120 may include a micro-phone to receive speech of a user. The user input unit 130 may include one or more user input devices, for example, a keypad, a touch pad, a touch screen, and the like, that may be used to receive a user input signal.

In the example shown in FIG. 1, the control unit 110, the audio input unit 120, the user input unit 130, the output unit 140, the display unit 150, the storage unit 160, and the communication unit 170 are each separate units. However, one or more of the control unit 110, the audio input unit 120, the user input unit 130, the output unit 140, the display unit 150, the storage unit 160, and/or the communication unit 170, may be combined into the same unit.

The output unit 140 outputs user speech together with an avatar based video message. The display unit 150 includes a display device to output data processed in the control unit 110 in the form of display information. The storage unit 160 may store an operating system, one or more applications used for the operation of the apparatus 100, and/or data to generate an avatar based video message. The communication unit 170 transmits an avatar based video message of the apparatus 100 to another apparatus, for example, over a network, such as a wired network, a wireless network, or a combination thereof.

The apparatus 100 may be implemented in various apparatuses or systems, for example, a personal computer, a server computer, a mobile terminal, a set-top box, and the like. A moving picture mail service may be provided using an avatar based video message. In addition, a video mail service may be provided using an avatar based video message in cyber space through a communication network. Using the apparatus 100, users may generate and share avatar based video messages.

Figure 2:
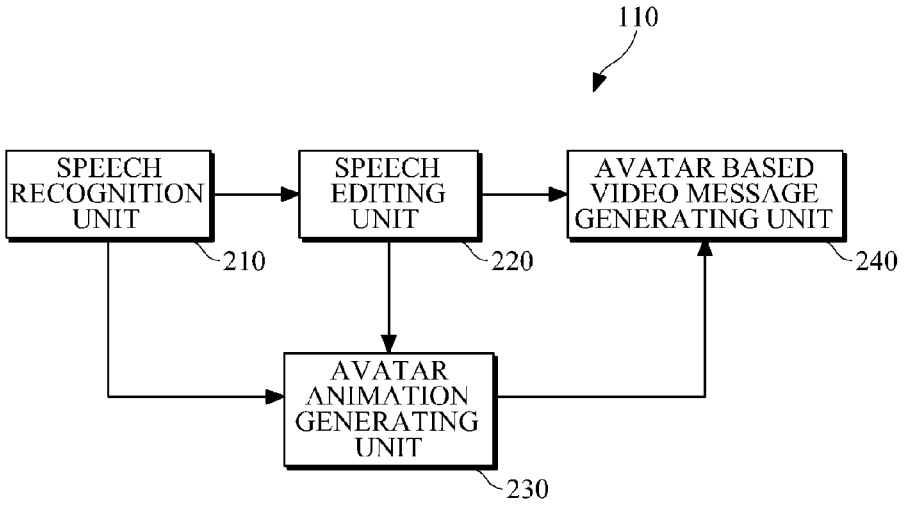
FIG. 2 is a diagram illustrating an example of a control unit that may be included in the apparatus illustrated in FIG. 1.

FIG. 2 illustrates an example of a control unit that may be included in the example apparatus illustrated in FIG. 1.

The control unit 110 includes a speech recognition unit 210, a speech editing unit 220, an avatar animation generating unit 230, and an avatar based video message generating unit 240. The speech recognition unit 210 may perform speech recognition by digitizing an audio input that is input from the audio input unit 120, sampling the digitized speech at predetermined periods, and extracting features from the sampled speech. The speech recognition unit 210 may perform speech recognition to generate a word sequence. In addition, the speech recognition unit 210 may generate synchronization information for synchronizing words included in speech and words included in the word sequence. The synchronization information may include time information, for example, information indicating a start point and an end point of speech sections corresponding to words included in the word sequence.

The input speech, the word sequence converted from the speech, and/or the synchronization information for respective words are referred to as editing information. The editing information may be used for speech editing. The editing information may be stored in the storage unit 160. Speech data sections for respective word sections of the input speech, words (or text) for the respective speech data sections, and/or synchronization information for the respective speech data and words may be stored in the storage unit 160 in association with each other.

The speech editing unit 220 may edit speech information based on the word sequence converted by the speech recognition unit 210 and the synchronization information. Speech information editing may include at least one editing action, for example, a deletion, a modification, and an insertion. The deleting is performed by deleting at least one character or word included in the word sequence corresponding to the speech. The modification is performed by modifying at least one word included in the word sequence into another word.

The insertion is performed by inserting one or more characters and/or words inside the word sequence.

The speech editing unit 220 may modify respective words of speech information and synchronization information corresponding to the respective words of the speech information, according to the speech data editing. The speech editing unit 220 may perform speech information editing at a predetermined location selected by a user input signal. The structure and operation of the speech editing unit 220 are described below with reference to FIG. 3.

The avatar animation generating unit 230 may generate avatar animation based on a word sequence and synchronization information that are input from the speech recognition unit 210. The avatar animation generating unit 230 may generate avatar animation based on an edited word sequence and modified synchronization information of the edited word sequence that are input from the speech editing unit 220. The avatar animation generating unit 230 may generate an animation having expression features, for example, lip synchronization, facial expressions, and gestures of an avatar based on the input word sequence and synchronization information.

The avatar based video message generating unit 240 generates avatar animation that moves in synchronization with speech, based on synchronization information and an avatar based video message including speech information. The avatar based video message may be provided in the form of an avatar animation image together with speech that is output through the output unit 140 and the display unit 150. A user may check the generated video message. If modification is desired, the user may input editing information through the user input unit 130, so that the apparatus 100 performs the operation of generating an avatar based video message starting from the speech editing. Such a process may be repeated until the user determines that speech editing is not desired.

Figure 3:
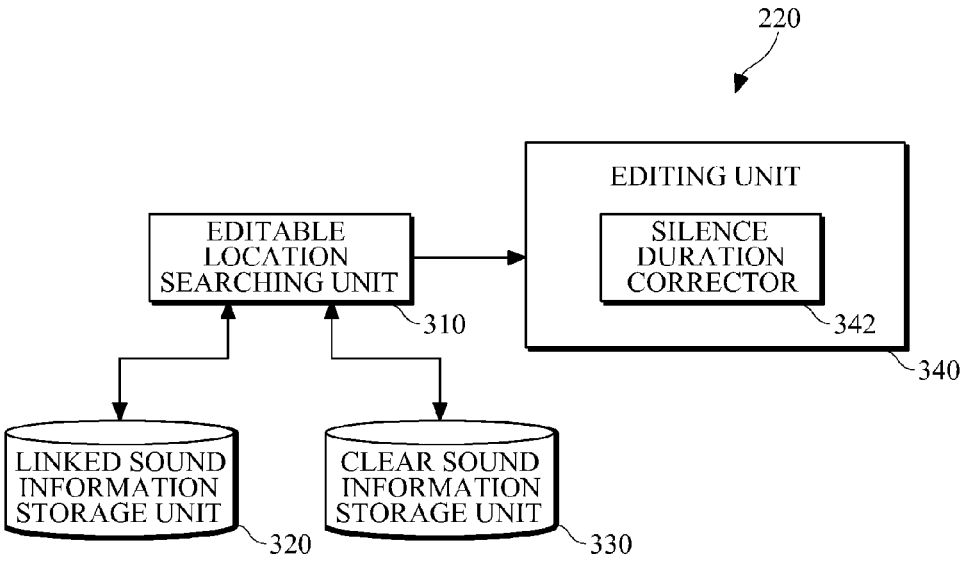
FIG. 3 is a diagram illustrating an example speech editing unit that may be included in the control unit illustrated in FIG. 2.

FIG. 3 is a view showing an example speech editing unit that may be included in the control unit illustrated in FIG. 2.

The speech editing unit 220 includes an edit location searching unit 310, a linked sound information storage unit 320, a clear sound information unit 330, and an editing unit 340.

A user may input a command, for example, a deletion, a modification, and/or an insertion editing command. The command may occur at a particular section of the word sequence. The speech may be continued naturally before/after the edited section. For example, if speech editing occurs at an arbitrary location of the word sequence, the edited speech information may sound unnatural. According to the apparatus 100 shown in FIG. 1, the speech editing unit 220 may determine an editable location and output information about the determined editable location to the display unit 150 such that a user may check the editable location. Accordingly, a user may edit the speech at a desired location.

The edit location searching unit 310 may determine an editable location in a word sequence converted from an input speech. The editable location may be displayed to the user through the display unit 150. The information indicating the editable location may include visual indication information that allows words included in the word sequence to be displayed distinctively. For example, the visual indication information may include a cursor that may move in editable block units of words included in a word sequence, according to a user input signal. The block unit may include one or more characters of a word, for example, one character, two characters, three characters, or more. The block unit may include one or more words, for example, one word, two words, three words, or more.

The edit location searching unit 310 may determine, as the editable location, a location of a boundary. The boundary may be positioned among speech sections corresponding to respective words included in the word sequence and has an energy below a predetermined threshold value.

Figure 4:
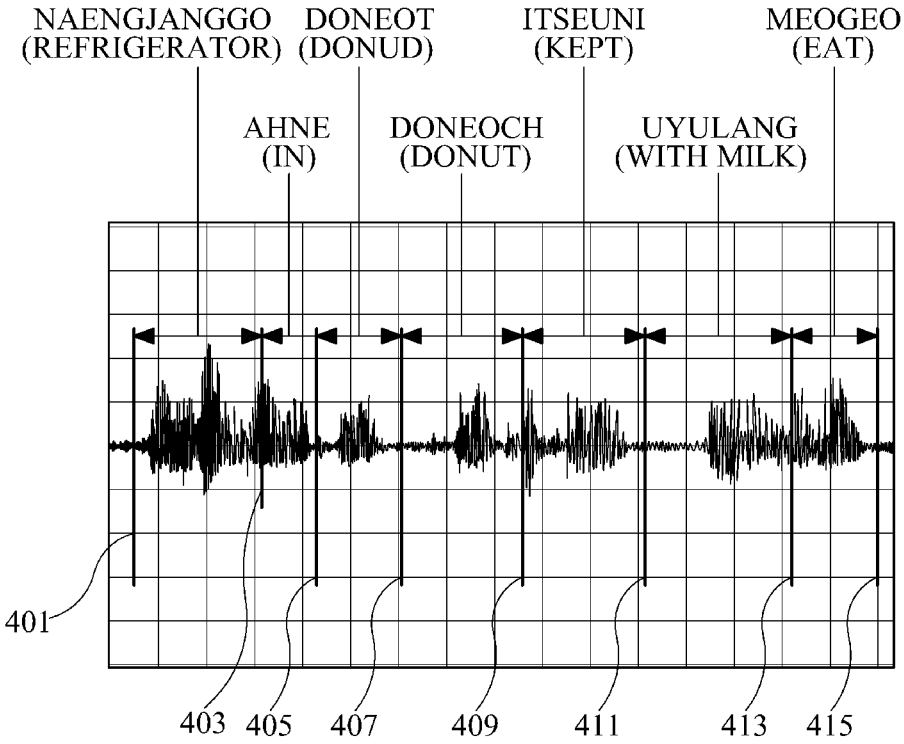
FIG. 4 is a graph illustrating an example in which the energy of a word sequence is measured over time.

FIG. 4 illustrates an example in which the energy of a word sequence is measured. The energy of the word sequence may be measured to search for an editable unit. FIG. 4 is a result of measuring the energy of speech of, for example, the Korean sentence "naengjanggo ahne doneot doneoch itseuni uyulang meogeo."

As provided herein, the Korean sentence or word sequence is enunciated and written using the English alphabet. In the figures, the translation of the Korean word(s) is provided in the parenthesis. For example, the Korean word(s) "naengjanggo," "ahne," "doneot," "doneoch," "itseuni," "uyulang," and "meogeo" can be translated as "refrigerator," "in," "donud," "donut," "there," "with milk," and "eat," respectively. The Korean word "itseuni" can also be translated as "kept" in view of the sentence or word sequence. The Korean word, "doneot," represents a word erroneously vocalized and the corresponding translation is provided as "donud." For the purpose of illustration, the translation "donud" is "donut" misspelled. Further description is provided with reference to FIG. 6. The sentence "naengjanggo ahne doneot doneoch itseuni uyulang meogeo" can be translated as "the donud donut is kept in the refrigerator, eat the donut with milk."

As shown in FIG. 4, boundaries 401, 403, 405, 407, 409, 411, 413 and 415 are included in the energy of the sentence "naengjanggo ahne doneot doneoch itseuni uyulang meogeo." The phrase "naengjanggo ahne" is composed of two words, but energy of a boundary 403 positioned between the two words may be determined to exceed a threshold value. Accordingly, the boundary 403 may be excluded from an editable location and the remaining boundaries 401, 405, 407, 409, 411, 413 and 415 may be determined as editable locations. As a result, editing may not be performed at the boundary between the two words "naengjanggo" and "ahne."

Referring again to FIG. 3, when at least two words are vocalized, the edit location searching unit 310 may exclude a location of a boundary between the words producing a linking from an editable location. The edit location searching unit 310 may determine the editable location based on information stored in a linked sound information storage unit 320 and a clear sound information storage unit 330.

The linked sound information storage unit 320 may include pronunciation information about a plurality of words that are pronounced as linked sounds. The clear sound information storage unit 330 may include pronunciation information about a plurality of words that are not pronounced as linked sounds. The linked sound information storage unit 320 and the clear sound storage unit 330 may be stored in a predetermined space of the storage unit 160 or the speech editing unit 220.

The edit location searching unit 310 may calculate a linked sound score that refers to an extent to which at least two words are recognized as linked sounds, and a clear sound score that refers to an extent to which at least two word are recognized as clear sounds. If a value obtained by subtracting the clear sound score from the linked sound score is below a predetermined threshold value, the edit location searching unit 310 determines that the at least two words are vocalized as clear sounds. Accordingly, the edit location searching unit 310 determines, as the editable location, a location corresponding to a boundary between the at least two words vocalized as clear sounds. The linked sound score may be calculated through isolated word recognition with reference to information stored in the linked sound information storage unit 320. The clear sound score may be calculated through word recognition with reference to information stored in the clear sound information storage unit 330.

For example, for a Korean word sequence "eumseong pyeonzib iyongbangbeob," which can be translated as "speech," "editing," "a method of using," respectively, the phrase "pyeonzib iyong" (editing use), may be vocalized as linked sounds "pyeonzi biyong" (postal rates), or non-linked or clear sounds "pyeonzip iyong" (editing use). The two have completely different meanings.

In this example, a speech recognition score may be measured with respect to respective speeches or words vocalized as the linked sounds. For example, if a value obtained by subtracting the non-linked or clear sound score from the linked sound score exceeds a predetermined threshold value, the speeches or words may be regarded as vocalized as linked sounds. Accordingly, in this case, the two words "pyeonzip" (editing) and "iyong" (use) are subject to editing only in the combined form of "pyeonzip iyong" (editing use).

If the word sequence is displayed in editable units, a user may check the displayed editable locations and select at least one editable location to input an editing command. Then, the editing unit 340 may edit the word sequence at the editable location according to a user input signal. If a modification command or an insertion command is input during the editing, the editing unit 340 may record new speech and performs speech recognition on the new speech, to generate a word sequence and synchronization information.

The methods described above for determining an editable location may be selectively used. That is, a user may decide which method for determining an editable location is used. After both of the methods have been sequentially performed on a word sequence including at least two words, a predetermined location satisfying the two methods may be determined as a final editable location and may be provided to the user.

Meanwhile, when the apparatus 100 records speech from a user for the purpose of insertion or modification, a silence may be generated at a start point and an end point of the recorded speech. If the duration of the silence is unnecessarily long, when the entire speech is compiled, the edited portion may sound awkward due to the unnecessary length of the silence. Accordingly, the editing unit 340 may adjust the length of the silence through a silence duration correction such that the modified speech sounds natural to the user.

The editing unit 340 may include a silence duration corrector 342. The silence duration corrector 342 shortens a silence generated when at least one word included in a word sequence is deleted or new speech is input, to insert a new word into a previous word sequence. For example, the silence duration corrector 342 shortens a silence such that the silence has a maximum length of 20 ms, 30 ms, 40 ms, 50 ms, and the like. Similar to the word sequence, synchronization information corresponding to a start point and an end point of a silence may be obtained.

Speech recognition may be performed when new speech is recorded for an insertion command or a modification command. If a silence is recognized as a word and allowed to be disposed before/after speech, synchronization information for a silence may be obtained together with a new word sequence. After the silence duration correction has been performed, the previous word sequence and synchronization information may be modified.

FIG. 5 illustrates an example of a table that is generated based on a determined editable unit.

As shown in FIG. 5, synchronization information, for example, information about a word sequence corresponding to input speech and a start time and an end time of voice data corresponding to each word of the word sequence, may be obtained based on speech recognition. The editing unit 340 may processes, for example, the Korean phrase "naengjanggo ahne" (in refrigerator) that is determined as an editing unit in FIG. 4, so that a previous word sequence and a previous synchronization information table 510 may be converted into a current word sequence and a current synchronization information table 520, and then stored in the storage unit 160.

Figure 6:
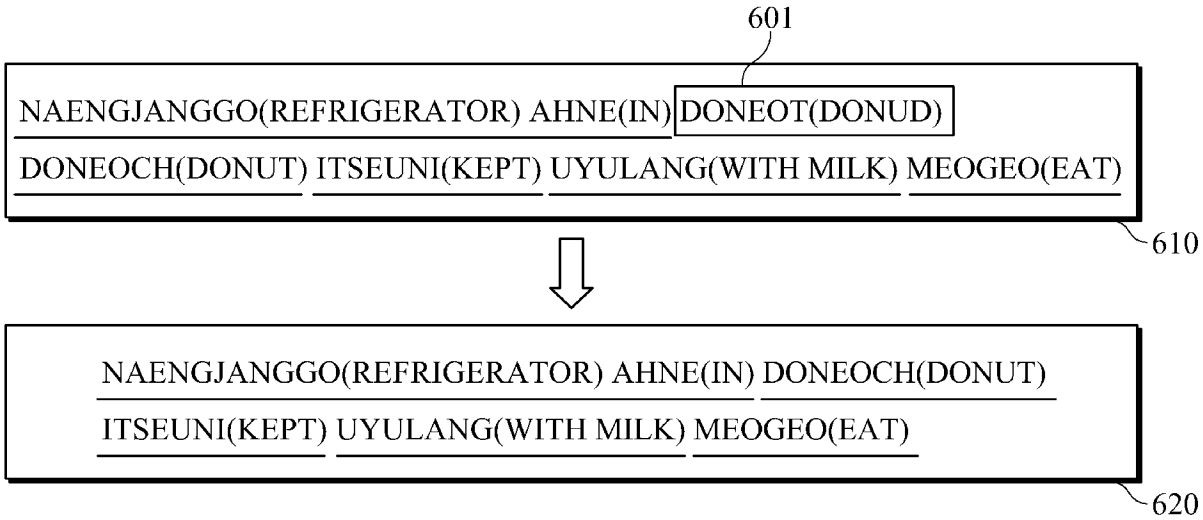
FIG. 6 is a speech editing display illustrating an example deletion operation.

FIG. 6 illustrates a display including an example deletion operation. Referring to FIG. 6, a recognized word sequence, for example, "naengjanggo ahne doneot doneoch itseuni uyulang meogeo" is displayed on the display unit 150. A user may determine that a portion of the word sequence, that is, the word "doneot" (donud), is erroneously vocalized from the displayed word sequence.

As described above with reference to FIG. 4, if the boundaries 401, 405, 407, 409, 411, 413 and 415 are determined as the editable locations, respective editable units of the word sequence may be displayed as shown inside a word sequence information block 610. For example, the word sequence may be underlined at each editable unit, so that a user may easily check words corresponding to the respective editable units. If the user places a cursor on the term "doneot" (donud) in block 601, the word "doneot" (donud) may be displayed in a highlighted fashion. Underlining and highlighting are examples of distinctively displaying editable units. These are merely provided as examples, and other processes for distinctively displaying the editable units may be used, for example, enlarging the size of selected editable units, changing the font of edible units, and the like. While FIG. 6 shows both Korean words and its translation in parenthesis, for example, "doneot" and the misspelled translation "donud" as highlighted, the terms in parenthesis are provided to translate the Korean words, and that the word sequence displayed on the display unit 150 is "naengjanggo ahne doneot doneoch itseuni uyulang meogeo."

In addition, an icon (not shown) indicating a speech editing type may be provided along with the word sequence information block 610. For example, if a user issues a deleting command by selecting a deleting icon, the erroneously vocalized portion "doneot" (donud) may be deleted from a word sequence. For example, the control unit 110 may delete a speech section corresponding to "doneot" (donud) from a speech file storing speech corresponding to the word sequence information block 610. The speech may be deleted based upon the word sequence and synchronization information for speech stored in the storage unit 160. As a result of the speech editing, the block 601 corresponding to "doneot" (donud) may be deleted from the word sequence information block 610 such that a word sequence information block 620 is displayed.

Figure 7:
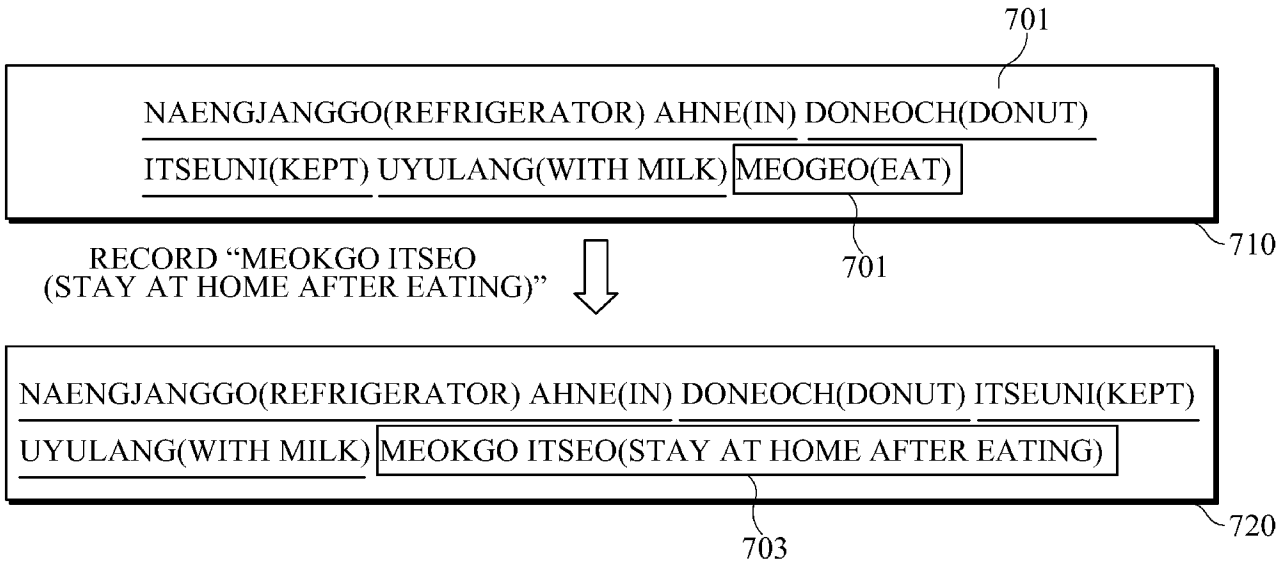
FIG. 7 is a speech editing display illustrating an example modification operation.

FIG. 7 illustrates a display including an example modification operation. Referring to the example in FIG. 7, the word "meogeo" (eat) may be modified into the phrase "meokgo itseo" (stay after eating). A recognized word sequence, for example, "naengjanggo ahne doneoch itseuni uyulang meogeo" is displayed on the display unit 150 inside a word sequence information block 710.

If a user selects the word of "meogeo" (eat) through the user input unit 130, the selected word may be displayed in a highlighted fashion. In addition, if the user issues a modification command by selecting a modification icon, the control unit 110 may enter a standby mode to receive a word sequence that may replace the word "meogeo" (eat).

New speech inputted through the audio input unit 120 and the new speech may be converted into a word sequence "meokgo itseo" (stay after eating). The phrase "meokgo itseo" can also be translated as "stay at home after eating" in view of the sentence or word sequence. The control unit 110 may delete the speech section "meogeo" (eat), and may place "meokgo itseo" (stay at home after eating) into the deleted location. For example, the control unit 110 may modify the word sequence and synchronization information to reflect the result of replacing "meogeo" (eat) with "meokgo itseo" (stay at home after eating). According to such a speech editing, an edited word sequence information block 720 including a block 703 of "meokgo itseo" (stay at home after eating) may be displayed.

If another sentence is connected subsequent to a word sequence shown in the word sequence information block 710, the control unit 110 may modify synchronization information about a word sequence corresponding to the other sentence. For example, if the length of newly recorded speech is shorter than that of the speech corresponding to "meogeo" (eat), the control unit may move forward synchronization information of a starting word of the other sentence. The sentence in the word sequence information block 720, "naengjanggo ahne doneoch itseuni uyulang meokgo itseo," can be translated as "the donut is kept in the refrigerator, stay at home after eating the donut with milk."

Figure 8:
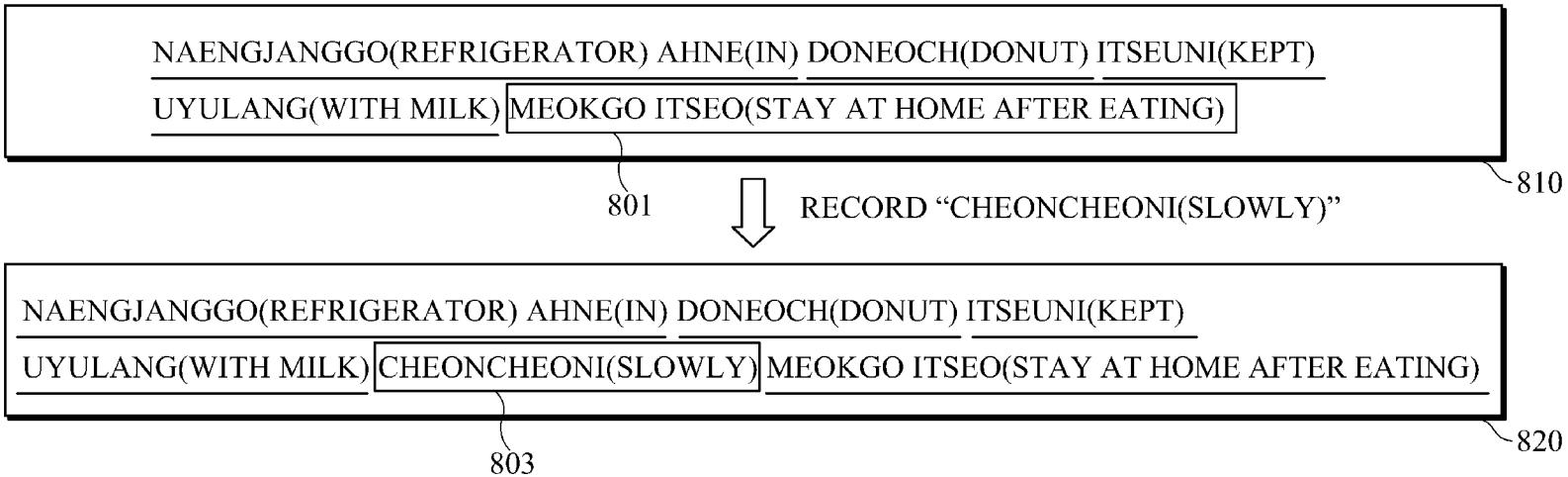
FIG. 8 is a speech editing display illustrating an example insertion operation.

FIG. 8 illustrates a display including an example insertion operation. Referring to the example of FIG. 8, a word "cheoncheoni" (slowly) may be inserted in front of "meokgo itseo" (stay at home after eating). As shown in a word sequence information block 810, a recognized word sequence, for example, "naengjanggo ahne doneoch itseuni uyulang meokgo itseo" is is displayed through the display unit 150. A user may determine a location in front of a block 801 corresponding to "meokgo itseo" (stay at home after eating) as an editable location, and perform an insertion command by selecting an insertion icon.

The control unit 110 may enter a standby operation to receive a new speech input. New speech corresponding to a phrase "cheoncheoni" (slowly) may be input through the audio input unit 120 and may be converted into a word sequence "cheoncheoni" (slowly), and the speech "cheoncheoni" (slowly) may be recorded. After that, the speech may be subject to speech recognition, and the recognized word sequence and synchronization information may be generated. In the example shown in FIG. 8, the control unit 110 inserts the phrase "cheoncheoni" (slowly) in front of "meokgo itseo" (stay at home after eating) and modifies the word sequence and the synchronization information for the word sequence based on the newly inserted speech. As a result of the insertion editing, a word sequence information block 820 including an inserted block 803 corresponding to "cheoncheoni" (slowly) may be displayed. The sentence in the word sequence information block 820, "naengjanggo ahne doneoch itseuni uyulang cheoncheoni meokgo itseo," can be translated as "the donut is kept in the refrigerator, s eat the donut with milk slowly and stay at home."

Figure 9:
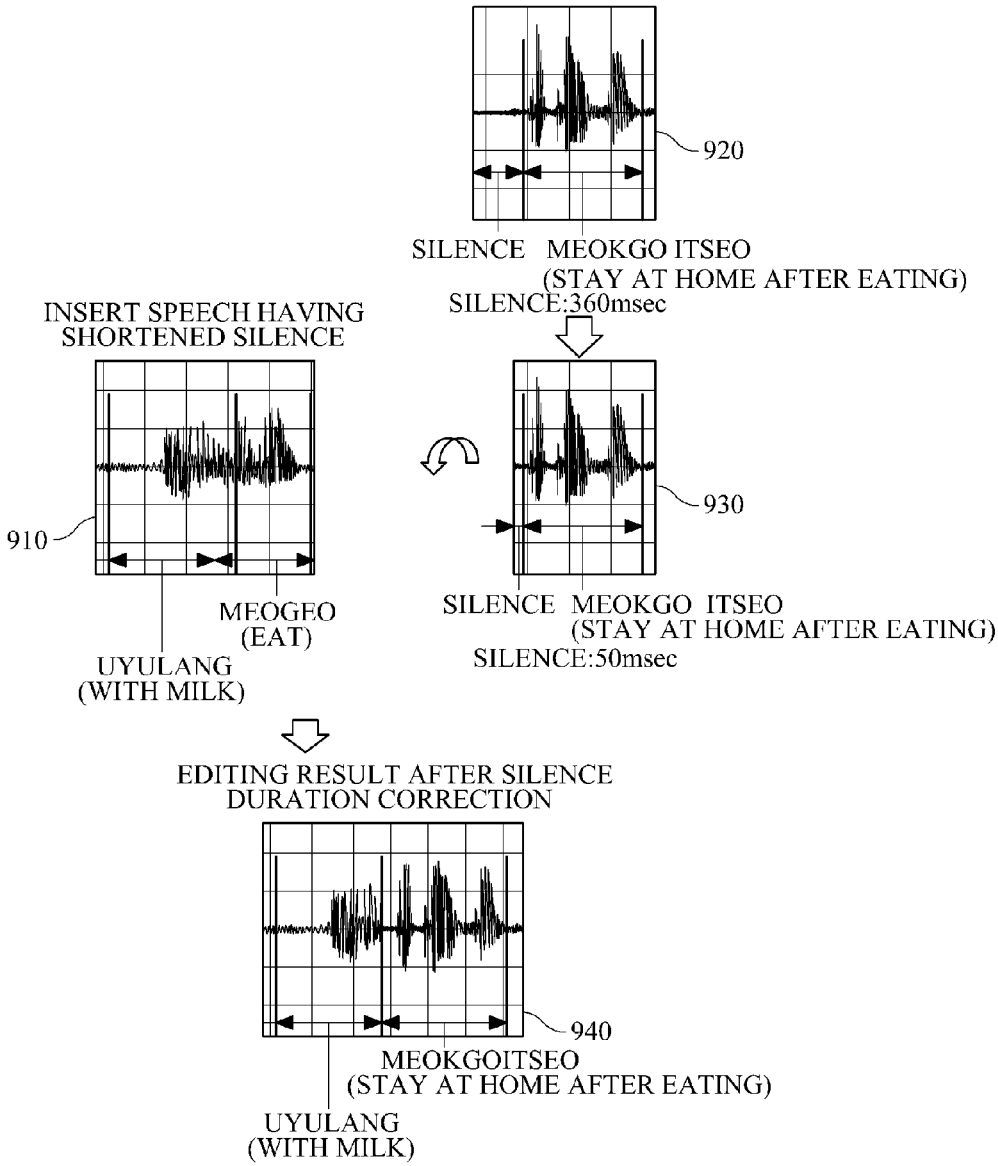
FIG. 9 includes graphs illustrating examples of speech waveforms according to a silence correction.

FIG. 9 illustrates examples of speech waveforms according to a silence corrector. In the example where the speech section of "meogeo" (eat) is replaced with "meokgo itseo" (stay at home after eating), as shown in FIG. 7, the control unit 110 may detect a silence portion from a speech section 920 corresponding to "meokgo itseo" (stay at home after eating). If the silence portion exceeds a threshold duration, the control unit 110 may shorten the portion of silence below the threshold duration. For example, as a result of a speech recognition, if the speech segment 920 has a silence portion of 360 ms, the control unit 110 may determine that 360 ms is above a threshold value, and may shorten the silence portion into a threshold value or below a threshold value, for example, 50 ms, or other desired duration. The control unit 110 may replace the speech section 920 into a speech segment 930 having a shortened silence in a current voice data 910, so that editing result after silence duration correction is generated.

Figure 10:
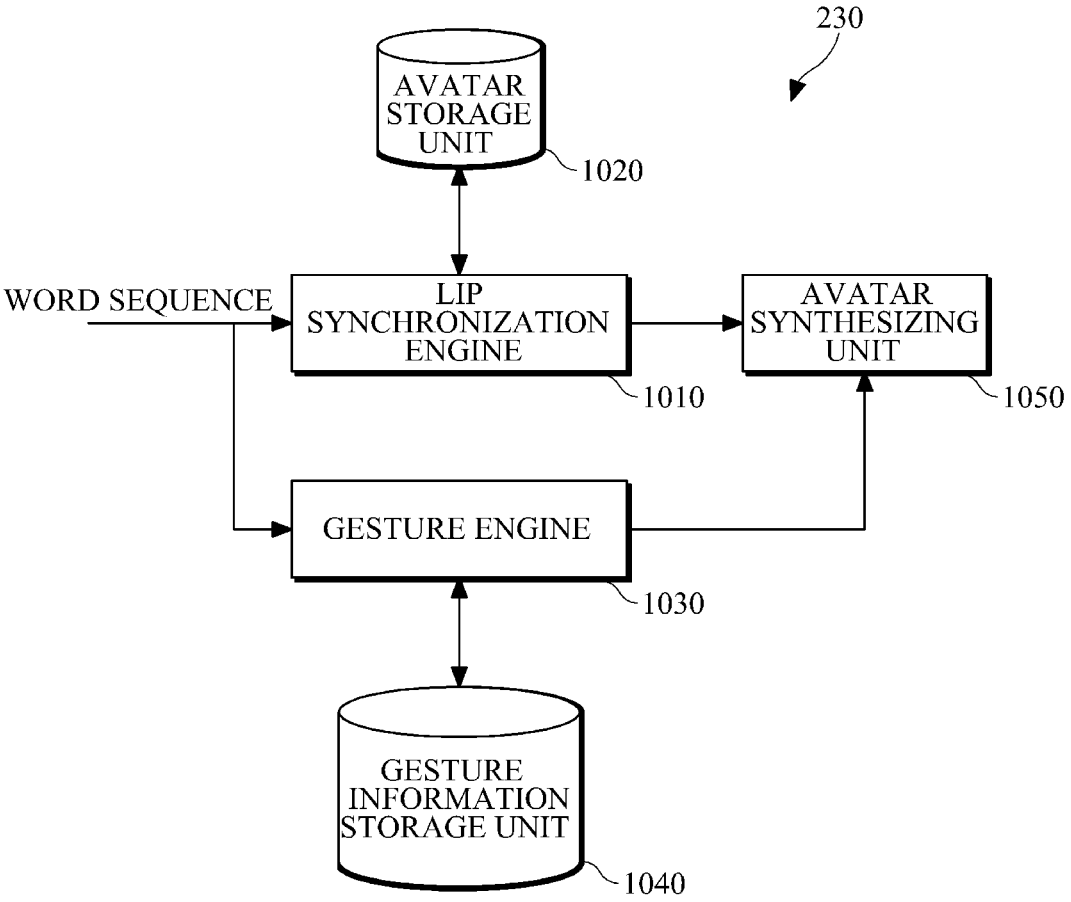
FIG. 10 is a diagram illustrating an avatar animation generating unit.

FIG. 10 illustrates an example of an avatar animation generating unit. The avatar animation generating unit 230 includes a lip synchronization engine 1010, an avatar storage unit 1020, a gesture engine 1030, a gesture information storage unit 1040, and an avatar synthesizing unit 1050.

If a word sequence is input, the lip synchronization engine 1010 may implement a change in the mouth of an avatar based on the word sequence. The avatar storage unit 1020 may store one or more avatars each having a lip shape corresponding to a different pronunciation. The lip synchronization engine 1010 may use the information stored in the avatar storage unit 1020 to output an avatar animation having a lip shape varying with the pronunciation of the words included in the word sequence.

The lip synchronization engine 1010 may generate lip shapes in synchronization with time synchronization information of vowel sounds and/or labial sounds included in a word sequence. The vowel sounds for lip synchronization include, for example, a vowel such as "o" or "u" where lips are contracted, a vowel such as "i" or "e" where lips are stretched laterally, and a vowel such as "ah" where lips are open widely. Because the labial sounds "p, b, m, f, v" are pronounced by closing lips, the lip synchronization engine 1010 may efficiently achieve labial sound operation. For example, the lip synchronization engine 1010 may close lips in synchronization with the labial sounds provided in the word sequence, thereby representing natural lip synchronization.

The gesture engine 1030 may implement the change of body regions, such as arms and legs, in synchronization with an input word sequence. The gesture information storage unit 1040 may store a plurality of images of body regions corresponding to respective pronunciations, conditions, and/or emotions.

The gesture engines 1030 may automatically generate a gesture sequence by semantically analyzing the word sequence based on information stored in the gesture information storage unit 1040. Alternatively, a predetermined gesture may be selected according to a user input signal, and the gesture engine 1030 may generate a gesture sequence corresponding to the selected gesture.

The avatar synthesizing unit 1050 may synthesize an output of the lip synchronization generation engine 1010 with an output of the gesture engine 1030, thereby generating a finished avatar animation.

Figure 11:
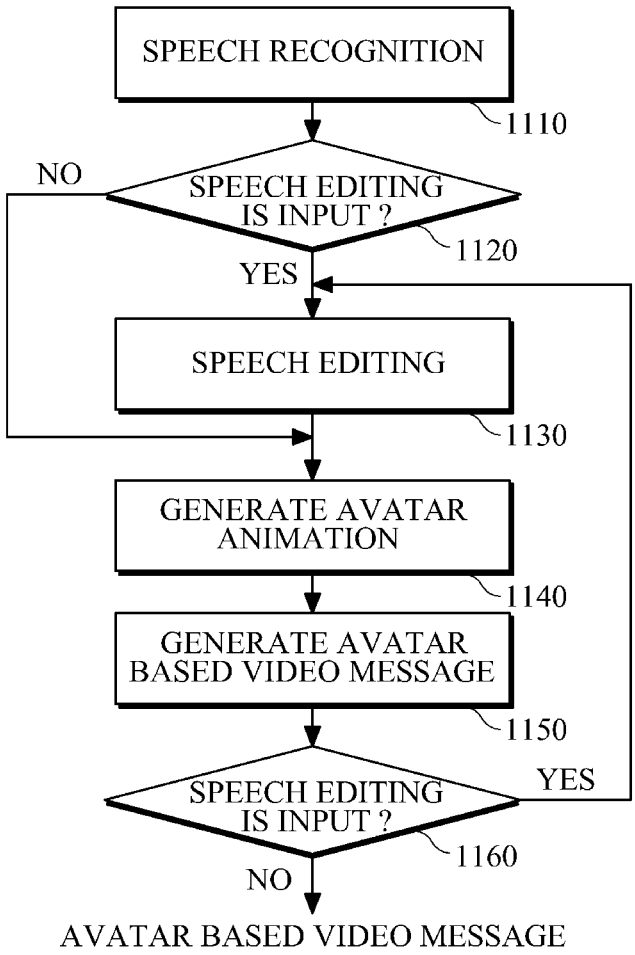
FIG. 11 is a flowchart illustrating an example of a method for generating an avatar based video message.

FIG. 11 illustrates an example of a method for generating an avatar based video message.

If a speech is input, in 1110, the apparatus 100 performs a speech recognition on the input speech, thereby converting the speech into a word sequence For example, synchronization information for respective words included in the word sequence may be determined. In addition, information about the word sequence and information indicating an editable location may be provided.

If a user input signal for speech editing is input in 1120, the avatar based video message generating apparatus, in 1130, edits the input speech according to the user input signal. If a user input signal for speech editing is not input in 1120, an avatar animation generating is performed in 1140.

The apparatus 100 may generate an avatar animation corresponding to the edited speech in 1140, and may generate an avatar based video message including the edited speech and the avatar animation in 1150. If a user wants to modify the avatar based video message, a user input signal for speech editing may be input in 1160 and the apparatus 100 may resume the speech editing in 1130. The speech editing operation in 1130, the avatar animation generating operation in

1140, and the avatar based video message generating operation in 1150, may be repeated until the user stops inputting editing signals.

The speech editing in 1130 does not need to be performed before the avatar animation generating in 1140. That is, before the speech editing is performed, the apparatus 100 may perform the avatar animation generating and the avatar based video message generating based on the current recognized word sequence and sync information. After the generated avatar based video message has been provided, if a user input signal for speech editing is input, the apparatus 100 may perform speech editing according to the user input signal, and then perform the avatar animation generating and the avatar based video message generating.

According to the example avatar based video message generating apparatus, an avatar based video message may be generated based on speech of a user. In addition, because a recognition result with respect to input speech of a user and an editable location are displayed to the user, a user may edit speech that have been previously input, thereby achieving a simplicity in generating an avatar based video message.

While a Korean sentence or word sequence has been described, it is understood that such descriptions have been provided for an illustrative purpose only and that implementations or embodiments are not limited thereto/therefor. For example, in addition to or instead of Korean, teachings provided herein can be applicable for a sentence or word sequence in spoken English or other language.

The processes, functions, methods and/or software described above may be recorded, stored, or fixed in one or more computer-readable storage media that includes program instructions to be implemented by a computer to cause a processor to execute or perform the program instructions. The media may also include, alone or in combination with the program instructions, data files, data structures, and the like. The media and program instructions may be those specially designed and constructed, or they may be of the kind well-known and available to those having skill in the computer software arts. Examples of computer-readable storage media include magnetic media, such as hard disks, floppy disks, and magnetic tape; optical media such as CD-ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa. In addition, a computer-readable storage medium may be distributed among computer systems connected through a network and computer-readable codes or program instructions may be stored and executed in a decentralized manner.

As a non-exhaustive illustration only, the terminal or terminal device described herein may refer to mobile devices such as a cellular phone, a personal digital assistant (PDA), a digital camera, a portable game console, and an MP3 player, a portable/personal multimedia player (PMP), a handheld e-book, a portable lab-top PC, a global positioning system (GPS) navigation, and devices such as a desktop PC, a high definition television (HDTV), an optical disc player, a setup box, and the like capable of communication or network communication consistent with that disclosed herein.

A computing system or a computer may include a microprocessor that is electrically connected with a bus, a user interface, and a memory controller. It may further include a flash memory device. The flash memory device may store N-bit data via the memory controller. The N-bit data is processed or will be processed by the microprocessor and N may be 1 or an integer greater than 1. Where the computing system or computer is a mobile apparatus, a battery may be additionally provided to supply operation voltage of the computing system or computer.

It will be apparent to those of ordinary skill in the art that the computing system or computer may further include an application chipset, a camera image processor (CIS), a mobile Dynamic Random Access Memory (DRAM), and the like. The memory controller and the flash memory device may constitute a solid state drive/disk (SSD) that uses a non-volatile memory to store data.

A number of examples have been described above. Nevertheless, it is understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for generating an avatar based video message, the apparatus comprising:

an audio input unit configured to receive speech of a user;

a user input unit configured to receive input from the user;

a display unit configured to output display information; and a control unit configured to perform speech recognition based on the speech of the user to generate a word sequence of the speech of the user, to generate editing information comprising the word sequence divided into a plurality of editable units based on a measured energy of the speech of the user, to generate avatar animation that moves based on the word sequence, and to generate an avatar based video message that vocalizes the word sequence of the speech of the user and that displays the avatar animation such that the avatar animation moves in synchronization with the vocalized word sequence.

2. The apparatus of claim 1, wherein the display unit is configured to display the editing information to the user, the editing information comprising the word sequence converted from the recognized speech and synchronization information for speech sections corresponding to respective words included in the word sequence.

3. The apparatus of claim 2, wherein the control unit is further configured to output information indicating the plurality of editable units through the display unit.

4. The apparatus of claim 3, wherein the information indicating the plurality of editable units comprises visual indication information that is used to display the word sequence such that the word sequence is differentiated into units of editable words.

5. The apparatus of claim 4, wherein the control unit is further configured to control the display unit such that a cursor serving as the visual indication information moves in steps of editable units in the word sequence.

6. The apparatus of claim 3, wherein the control unit is further configured to edit the word sequence at an editable unit according to a user input signal.

7. The apparatus of claim 3, wherein the control unit is further configured to determine, as an editable unit, a location of a boundary that is positioned among speech sections corresponding to the respective words of the word sequence and which comprises an energy below a predetermined threshold value.

8. The apparatus of claim 2, wherein the control unit is further configured to calculate a linked sound score that refers to an extent to which at least two words included in the word sequence are recognized as linked sounds;

the control unit is further configured to calculate a clear sound score that refers to an extent to which the at least two words are recognized as a clear sound; and if a value obtained by subtracting the clear score from the linked score is below a predetermined threshold value, the control unit is further configured to:

determine that the at least two words are vocalized as a clear sound; and determine, as the editable location, a location corresponding to a boundary between the at least two words determined as the clear sound.

9. The apparatus of claim 1, wherein the control unit is further configured to edit the speech based on an editing action that comprises at least one of a deletion, a replacement, and an insertion, the deletion action deleting at least one word included in the word sequence, the replacement action replacing at least one word included in the word sequence with one or more other words, and the insertion action inserting one or more new words into the word sequence.

10. The apparatus of claim 1, wherein the control unit comprises a silence duration corrector configured to shorten a section of silence included in new speech that is input to modify at least one word included in the word sequence or to insert a new word into the word sequence.

11. The apparatus of claim 1, wherein the control unit is further configured to generate the editing information comprising the word sequence divided into the plurality of editable units based on clear sounds and based on linked sounds.

12. A method of generating an avatar based video message, the method comprising:

receiving speech input by a user;

performing speech recognition on the input speech to generate a word sequence of the speech input by the user;

generating editing information comprising the word sequence divided into a plurality of editable units based on a measured energy of the speech of the user generating avatar animation that moves based on the word sequence; and generating an avatar based video message that vocalizes the word sequence of the speech of the user and that displays the avatar animation such that the avatar animation moves in synchronization with the vocalized word sequence.

13. The method of claim 12, further comprising:

displaying the editing information, wherein the editing information comprises the word sequence converted from the speech and synchronization information for speech sections corresponding to respective words included in the word sequence.

14. The method of claim 13, further comprising editing the word sequence, wherein the editing of the word sequence comprises:

displaying information indicating the plurality of editable units; and editing the word sequence at an editable unit that is selected according to a user input signal.

15. The method of claim 14, wherein the information indicating the plurality of editable units comprises visual indication information that is used to display the word sequence such that the word sequence is differentiated into units of editable words.

16. The method of claim 14, wherein the editable unit represents a location of a boundary that is positioned among speech sections corresponding to the respective words of the word sequence and which comprises an energy below a predetermined threshold value.

17. The method of claim 14, further comprising:

subtracting a clear sound score that refers to an extent to which at least two words included in the word sequence are recognized as a clear sound, from a linked sound score that refers to an extent to which the at least two words are recognized as a linked sound; and if the subtraction value is below a predetermined threshold value, determining that the at least two words are vocalized as a clear sound and determining, as the editable location, a location corresponding to a boundary between the at least two words determined as the clear sound.

18. The method of claim 12, wherein the speech is edited based on at least one editing action that comprises at least one of a deletion, a replacement, and an insertion, the deletion action deleting at least one word included in the word sequence, the replacement action replacing at least one word included in the word sequence with one or more other words, and the insertion action inserting one or more new words into the word sequence.

19. The method of claim 12, further comprising editing the word sequence, wherein the editing of the word sequence comprises shortening a section of silence included in new speech that is input to modify at least one word included in the word sequence or to insert a new word into the word sequence.

* * * * *